United States Patent [19]

Stroezel

[11] 4,108,252

[45] Aug. 22, 1978

[54] POWER DRIVER FOR THREADED FASTENERS

[75] Inventor: Reinhold Stroezel, Leinfelden-Oberaichen, Germany

[73] Assignee: Robert Bosch GmbH, Stuttgart, Germany

[21] Appl. No.: 550,954

[22] Filed: Feb. 19, 1975

[30] Foreign Application Priority Data

Mar. 1, 1974 [DE] Fed. Rep. of Germany ..... 2409815

[51] Int. Cl.[2] ..... B25B 21/00

[52] U.S. Cl. ..... 173/12; 64/29

[58] Field of Search ..... 173/12; 64/29; 192/150

[56] References Cited

U.S. PATENT DOCUMENTS

| | | | |
|---|---|---|---|
| 2,342,540 | 2/1944 | Hale | 64/29 |
| 3,477,521 | 11/1969 | Kiester et al. | 173/12 |
| 3,693,381 | 9/1972 | McGee | 64/29 |

*Primary Examiner*—Ernest R. Purser
*Assistant Examiner*—William F. Pate, III
*Attorney, Agent, or Firm*—Michael J. Striker

[57] ABSTRACT

A drive is mounted in a housing and an output shaft is coupled with the drive to be rotated by the same and is connectable with a fastener to be driven. An arrangement is provided for deactivating the drive when the torque acting on the output shaft exceeds a predetermined selectable level. This arrangement includes a plurality of surface portions which surround the axis of rotation of the shaft and which each of which is continuously inclined radially and circumferentially of the shaft. A plurality of transmitting members is mounted for torque-dependent shifting in direction radially of the axis, and biasing springs urge the members radially outwardly against respective ones of the surface portions.

11 Claims, 7 Drawing Figures

POWER DRIVER FOR THREADED FASTENERS

BACKGROUND OF THE INVENTION

The present invention relates to a power driver for threaded fasteners, such as screws, nuts and the like.

Power drivers of this type are manually-held units reserved to tighten and loosen screws, nuts and the like. They are known for applications where relatively low torque is required, and because of this, these prior-art drivers do not have any arrangements for disconnecting the drive motor from the output shaft or spindle when a maximum permissible torque is reached which acts upon the output spindle, i.e., when the fastener has been threaded tight to the maximum extent. Instead, it is sufficient to interrupt the supply of energy to the motor when the maximum permissible torque is reached. This type of power driver is, for instance, disclosed in U.S. Pat. Nos. 2,964,151 and 2,986,052 in which the motor is an air motor.

In many instances, power drivers of this prior-art type cannot be used, or can be used only with difficulty, because they are of necessity relatively long due to the fact that the air motor, the step-down gear and other components must be arranged in line. They can, therefore, not be used in applications where there is relatively little space.

SUMMARY OF THE INVENTION

Accordingly, it is an object of the present invention to provide an improved power driver for threaded fasteners which overcomes the aforementioned disadvantages.

More particularly, it is an object of the present invention to provide such an improved power driver which is shorter than those known from the prior art and is provided with an arrangement for automatically switching off the drive when the torque acting upon the output shaft reaches a predetermined selectable level.

In keeping with these objects, and with others which will become apparent hereafter, one feature of the invention resides in a power driver for screws, nuts and other threaded fasteners which, briefly stated, comprises a housing, a drive in the housing, and an output shaft connectable with a fastener to be driven and coupled with the drive for rotation by the same. Means is provided which acts upon the drive for deactivating the same when the torque on the output shaft exceeds a predetermined selectable level. According to the invention, this means includes a plurality of surface portions surrounding the axis of rotation of the shaft and each continuously inclined radially and circumferentially thereof, a plurality of transmitting members mounted for torque-dependent shifting in direction radially of the axis, and biasing springs urging these members radially outwardly against respective ones of the surface portions.

The novel features which are considered as characteristic for the invention are set forth in particular in the appended claims. The invention itself, however, both as to its construction and its method of operation, together with additional objects and advantages thereof, will be best understoof from the following description of specific embodiments when read in connection with the accompanying drawing.

DESCRIPTION OF THE PREFERRED EMBODIMENTS

Figure 1:
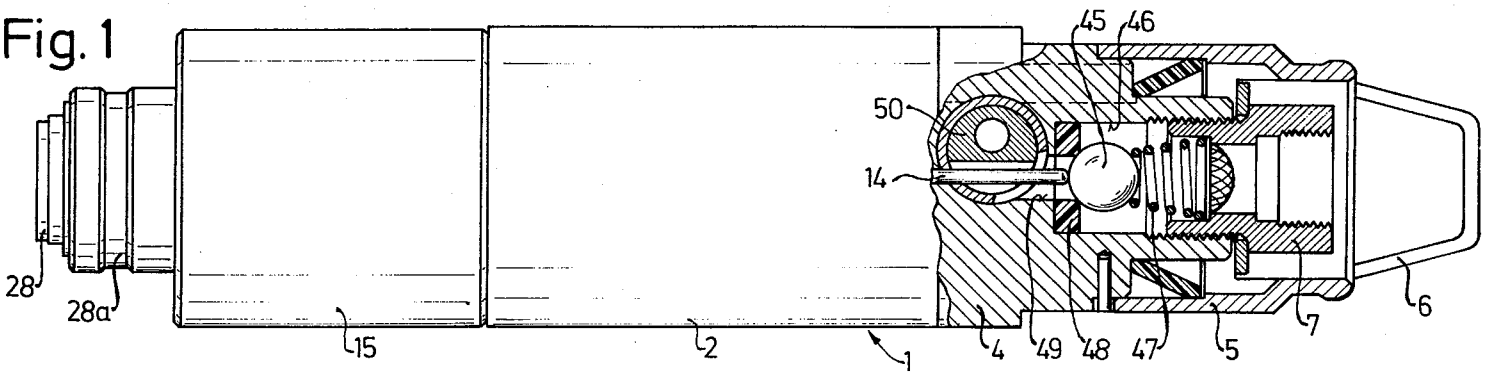
FIG. 1 is a partly sectioned top-plan view of a power driver according to the present invention.
Figure 2:
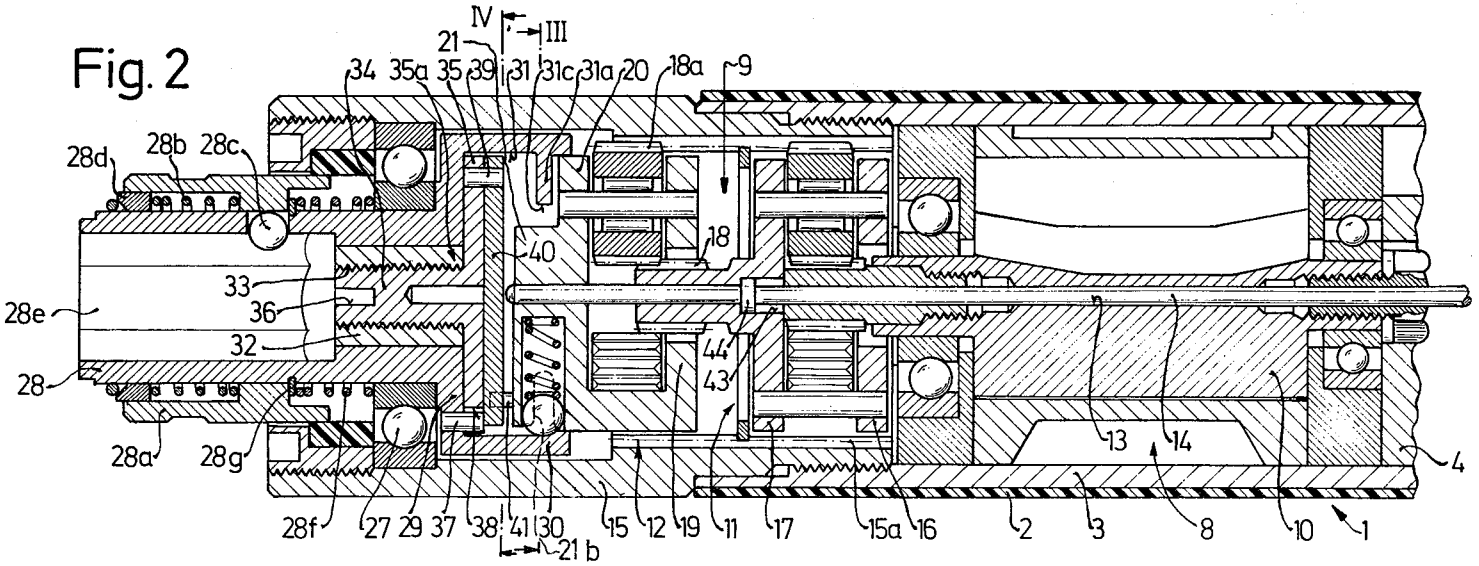
FIG. 2 is a fragmentary vertical section through the power driver of FIG. 1.

FIGS. 1–4 illustrate one embodiment of a power driver according to the present invention. This driver, identified generally by the reference numeral 1, has a motor housing 3 surrounded with a sleeve 2 of synthetic plastic material. A fitting 4 is threaded into the rear end of the housing 3 and an end cap 5 is mounted on the fitting 4 and provided with an eyelet 6 to make it possible to hang up the driver if so desired. An air inlet nipple 7 is threaded into the fitting 4 to supply an internal-rotor air motor 8 which is mounted in the motor housing 3 and the forward end of which (forward as seen with respect to the front end of the driver) is a two-stage planetary gear drive 9. The motor 8 and the gear drive 9 need not be described in detail, because they are entirely well known to those skilled in the art. The rotor 10 of the motor 8 and the two planetary carriers 11 and 12 have a central bore 13 in which a switching rod 14 is received, which is both turnable and axially shiftable. The planetary gear drive 9 is mounted in a housing 15 the inner wall of which is formed with an annulus **15*a* of teeth which is common to both planetary gear sets; the housing 15 is connected with the front end of the motor housing 3 via threads. The rearward planetary carrier 11 has a rear wall 16 and a front wall 17, the latter being formed with a sun gear 18 which has rather long straight teeth that mesh with the teeth of the planet gears 18*a* of the carrier 12. The latter is longitudinally shiftable in the housing 15 and has a rear wall 19 and a front wall 20; three projections 21 are formed on the front wall 20 and are connected with one another to form a three-armed star 21*a*. The projections 21 are each formed with a blind radial bore 22 which is so arranged that a core 23 remains between the inner ends 25 of the respective bores 22; the axially extending central bore 13 penetrates this core 23. Each of the bores 22 accommodates an expansion spring 24 which is compressed between the bottom 25 and a transmission member 26 which is here constructed as a ball that is being urged in radially outward direction, that is away from the axis of rotation. Each of the projections 21 has formed in it from the outer side in direction normal to the axis a slot 21*b* whose width is equal to approximately one-third to one-half of the diameter of the respective bore 22**.

An output shaft or tool spindle 28 is configurated as a tubular spindle and is turnably journalled in an antifriction bearing 27 that is mounted in the region of the front end of the housing 15. The spindle 28 is surrounded by a sleeve **28*a* which, in connection with an expansion spring 28*b*, a detent ball 28*c* and a ring 28*d* constitutes a rapid-release chuck for a non-illustrated tool, for example a screw driver bit that is insertable into a hexagonal bore 28***e* of the spindle 28*a*. The sleeve 28 is turnable on the spindle 28 but cannot be axially shifted thereon. A spring 28*f* is provided on the spindle 28 and engages with one end against the inner race of the bearing 27 and with its other end against a circlip 28*g* mounted on the spindle 28. The spindle thus can be shifted axially inwardly of the driver to a limited extent against the biasing force of the spring 28*f*. A plate or disc 29 is provided on the spindle 28 rearwardly of the bearing 27 and is of one piece with a transmission sleeve 30 which surrounds the star 21*a* and is slidably guided on the front wall 20 of the carrier 12.

A wall portion 31*a* is provided on the inner wall 31 of the sleeve 30, extending circumferentially and towards the axis; the wall portion 31*a* is somewhat narrower than the width of the slots 21*b* and forms three noses 31*b* which engage into the slots 21*b* when the star 21*a* is turned relative to the sleeve 30. The balls 26 are urged by the springs 24 into engagement with the surface portions 31*c* which face inwardly towards the axis of rotation. The surface portions 31*c* on each of the noses 31*b* have a spacing from the axis of rotation which continuously changes in circumferential direction, and increasing rotation of the star 21*a* with reference to the sleeve 30 will produce an increasing compression of the springs 24 and therefore an increasing transmittable torque. The star 21*a* and the sleeve 30 therefore constitute the driving and the driven element of an effective unit 30*a*. At the three points where the wall portion 31*a* contacts the inner wall 31 of the sleeve 30, the inner wall 31 is formed in the region of the rear end of the sleeve 30 with a low step 31*d* that faces inwardly towards the axis of rotation and which limits the freedom of movement of the balls 26 in rearward axial direction.

A sleeve 32 is press-fitted into the spindle 28 in the region of the bearing 27; it is formed with an internal thread 33 into which a bolt 34 is threaded. The bolt 34 has a thread so dimensioned that the bolt can be turned in the internal thread 33 only with some difficulty, so as not to become unintentionally loosensed. An adjusting disc or plate 35 is of one piece with the rear end of the bolt 34 and forms with the same an adjusting element 35*a*. The front end of the bolt has a slot 36 into which a screw driver can be inserted to permit turning of the bolt and its adjustment relative to the sleeve 32 and therefore relative to the spindle 28 and the sleeve 30. The angle of adjustment is limited by a pin 37 which is mounted in the disc 29 and engages into a slot 38 of the plate 35. The plate 35 can be angularly turned through a range which is determined by the engagement of the pin 37 with one or the other end of the slot 38.

A pin 39 is mounted in the plate 35 and mounted on this is a blocking member configurated as an arm 40 which pivots on the pin 39. An abutment pin 41 is so mounted in the front wall 20 of the carrier 12 that it extends into the pivoting path of the arm 40, and a tension spring 42 is secured in a hole of the plate 35 and to the arm 40, respectively, and permanently urges the arm 40 against the abutment pin 41.

The portion of the bore 13 which is located in the carrier 11 has a cylindrical enlargement 43, and a collar 44 of the rod 14 is located in this enlargement 43 and serves to limit the axial displacement of the rod 14 in forward and rearward direction. The rear end of the rod 14 engages a servo valve 45 which is received in a cavity 46 of the fitting 4 and is subjected to the pressure of an expansion spring 47 which also bears against the nipple 7; when the rod 14 is in its forward end position the valve member 45 engages a valve seat 48 which is mounted in the fitting 4 and provides a seal with the same. Forwardly of the valve seat 48 there is located an air channel 49 which is connected with the motor 8 via a direction reversing device 50.

In operation of the driver in FIGS. 1–4, a tool such as a screw driver bit is secured in the hexagonal recess 28*e* of the spindle 28 and its front end is placed onto the fastener to be turned, e.g., a screw. The star 21 is in such an angular position relative to the sleeve 30—since at this time no torque is exerted—that the balls 26 assume positions in which they are as far as possible from the axis of rotation and in which the springs 24 are as unstressed as possible. The blocking arm 40 is located across the path of axial displacement of the rod 14, that is it assumes the position shown in FIGS. 3 and 4. If the screw driver bit is now placed into the slot of the screw and some pressure is exerted in direction towards the screw, the spindle 28 shifts rearwardly into the driver against the resistance of the spring 28*f*, and the sleeve 30 carries the planetary carrier 12 with it in rearward direction; during this movement, the teeth of the planet gears 18*a* shift in the teeth of the sun gear 18. The blocking arm 40 presses the rod 14 rearwardly and the latter lifts the valve member 45 off the seat 48 so that compressed air can flow to the motor 8 which starts and rotates the spindle 28 via the planetary drive 9 and the unit 30*a* composed of the star 21*a* and the sleeve 30.

Figure 4:
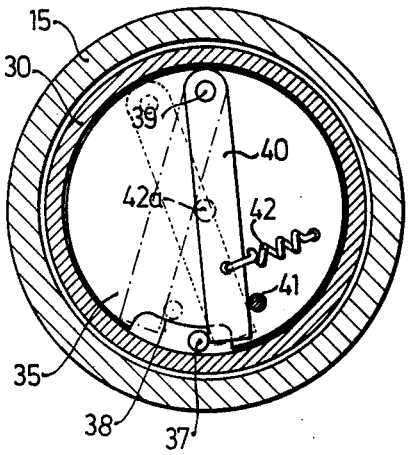
FIG. 4 is a section taken on line IV—IV of FIG. 2.
Figure 3:
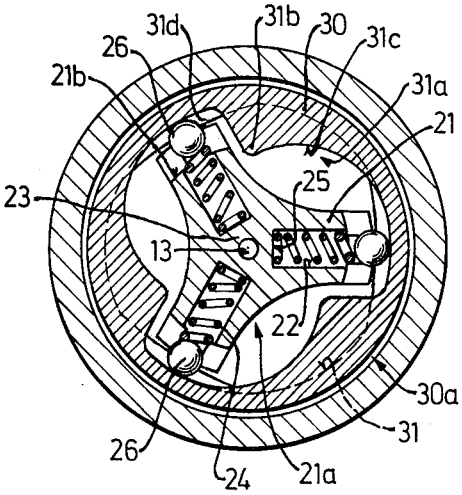
FIG. 3 is a section taken on line III—III of FIG. 2.

As soon as the threaded fastener which, for the example in question, is a screw, is tightened and the torque acting upon the spindle 28 increases, the star 21*a* shifts rotatably with reference to the sleeve 30 (in counterclockwise direction in FIG. 3) with the result that the balls 26 now move inwardly towards the axis of rotation and the springs 24 become stressed to a greater degree. FIG. 4 shows that the direction of rotation of the star 21*a* relative to the sleeve 30 (which in case of the illustration of FIG. 4 takes place in clockwise direction) causes a similar turning of the abutment pin 41 so that the blocking arm 40 is moved relative to the bore 42*a* of the bolt 34 until it is withdrawn from this bore, as shown in broken lines. As soon as the bore 42*a* is free, the rod 14 is pushed forwardly by the valve member 45, or rather the spring 47 acting upon the same, and enters into the bore 42*a*. The valve member 45 moves into engagement with the valve seat 48, interrupting the supply of compressed air to the motor 8 which now stops. Since there is now no further moment acting between the star 21*a* and the sleeve 30, the turning of these two parts relative to one another is reversed and the pin 41 withdraws from the arm 40. The latter cannot follow this movement since it is prevented from so doing by the rod 14 which has entered into the bore 42*a*.

As soon as the driver is lifted off the tightened screw, the spring 21*f* shifts the tool spindle 28 forwardly and the sleeve 30 moves with the spindle and takes along the star 21*a* and the carrier 12 with the planet gears 18*a* via the wall portion 31*a* that engages in the slots 21*b*. The rod 14 cannot follow this movement because no further force acts upon the rod 14 once the spring 47 has urged the valve member 45 into engagement with the valve seat 48, and also because its forward movement is prevented by engagement of the collar 44 with the front wall bounding the enlargement 43 of the bore 13. As soon as the forwardly moving arm 40 has shifted past the rod 14, it is snapped against the abutment pin 41 by the spring 42, and thus again blocks the bore 42*a*. The driver is now ready to be placed against another screw to be tightened, and as soon as it is urged towards the screw and the spindle 28 shifts inwardly of the driver, the motor 8 again receives compressed air and starts up.

FIG. 4 shows that when the bolt 34 is turned relative to the spindle 28, the pin 39 is shifted relative to the pin 41, for example into the position shown in dotted lines in which a substantially smaller angular displacement of the star 21*a* relative to the sleeve 30 is necessary to move the arm 40 away from the bore 42*a*. This means that less torque is required to effect such turning of the star 21*a*, and therefore the motor 8 will become deactivated when a lesser torque acts upon the spindle 28 than was described previously, which, of course, means that the screw will not be turned as tightly as previously, that is not as tightly as if the arm 40 were in the full line position. This means that the driver according to the present invention can be set for a desired torque and, therefore, that an operator can select how firmly he wishes the screw of the threaded fastener to be tightened.

Figure 5:
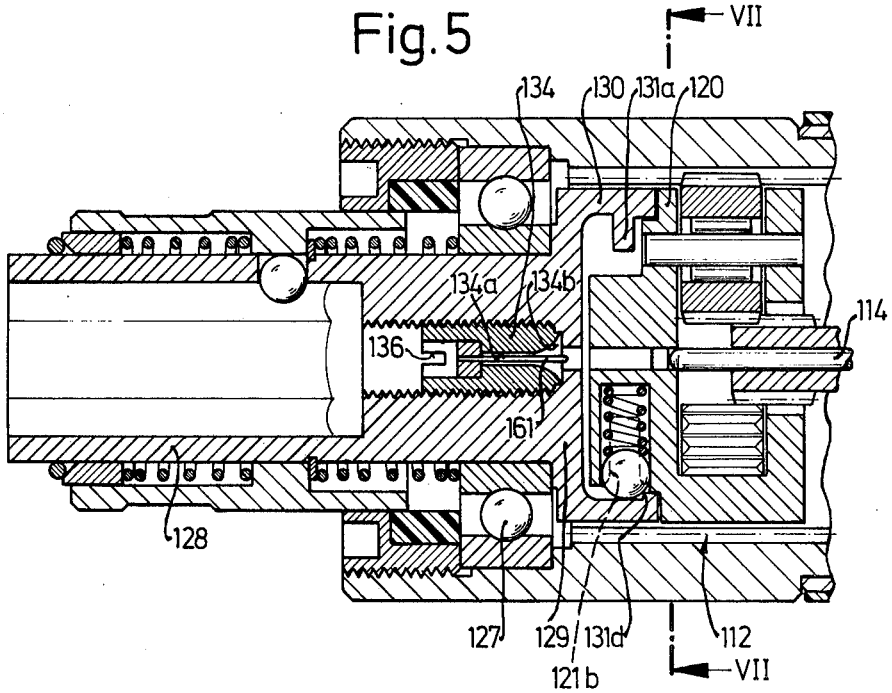
FIG. 5 is a fragementary section through the front end of a further embodiment of the invention.
Figure 6:
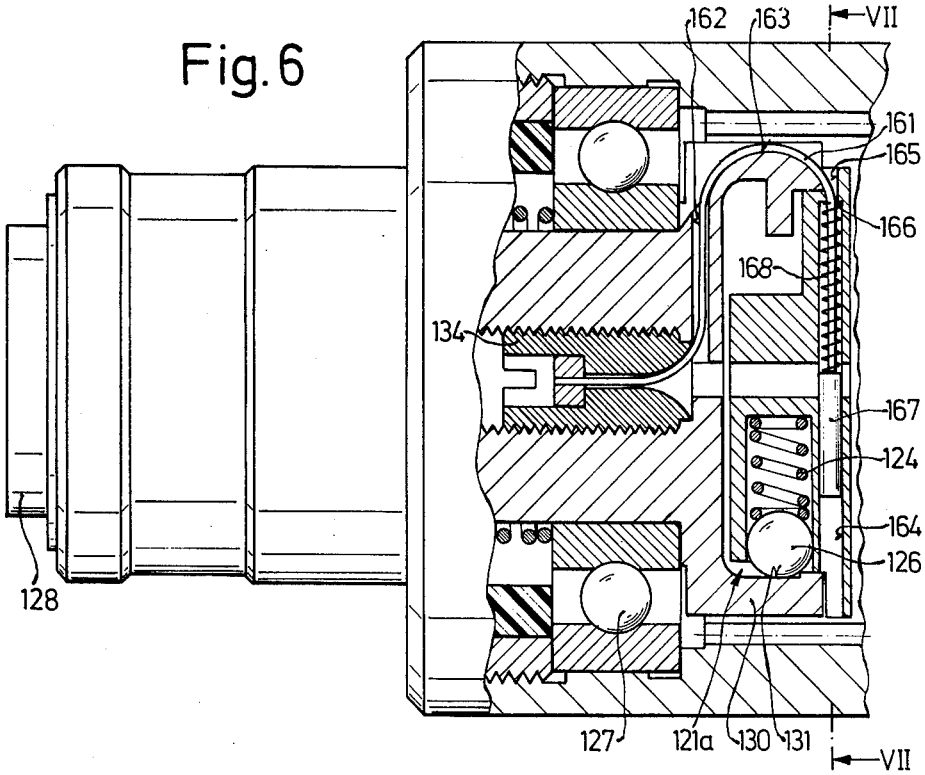
FIG. 6 is a section similar to that of FIG. 5, but showing the driver of FIG. 5 in a section which is offset through 120° with reference to FIG. 6.
Figure 7:
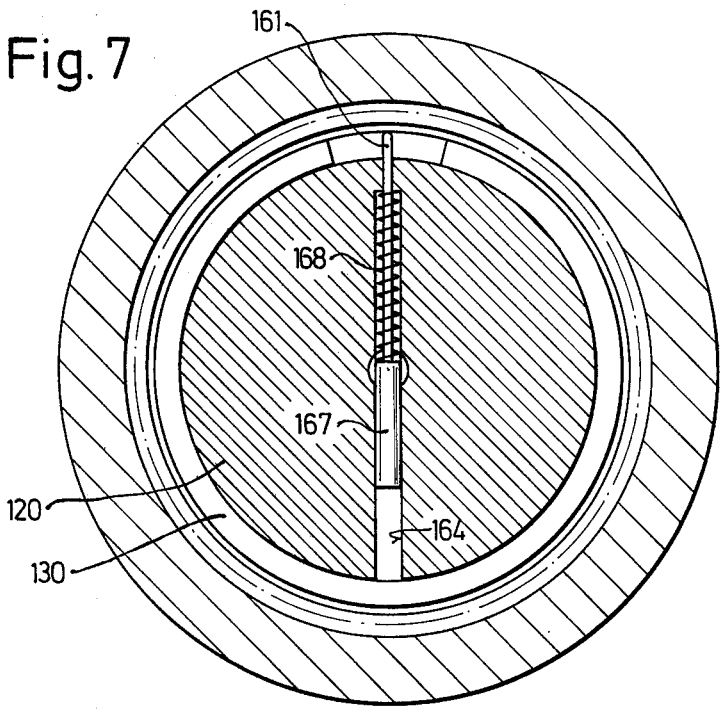
FIG. 7 is a section taken on line VII—VII as indicated in FIGS. 5 and 6.

FIGS. 5–7 illustrate a further embodiment of the invention which differs from that of FIGS. 1–4 essentially in that the arm 40 is replaced by a sliding member that is activated by means of a rope or the like. Like reference numerals are identified with like components as in FIGS. 1–4, but with the suffix 1 added.

In FIGS. 5–7, the tool spindle 128 has threaded into it, in the region of its bearing 127, a member in form of a plug 134 which is formed in its forward end with a slot 136 for engagement by a screw driver. At its rearward end, the plug 134 has connected to it a rope or similar tensile element 161 which extends through a longitudinal bore 134*a* that is formed at its rear end with a rounded portion 134*b* which assures that when the tensile element 161 is deflected its bending radius is relatively large so that the bending stresses acting upon the tensile element 161 are mitigated. The disc 129 which is formed at the rear end of the spindle 128 is provided with a radial bore 162, and at the outer surface of the sleeve 130 there is formed a surface 163 that constitutes a part of an annular bead. The surface 163 has the tensile element 161 passing over it and makes is possible to deflect the element 161 from the bore 162 in radially inward direction, that is towards the axis of rotation, and also to deflect it laterally out of the plane which is determined by the bore 162 and the axis of rotation. The planetary carrier 112 has a front wall 120 on which the sleeve 130 is guided. Rearwardly of the star 121*a* the wall 120 is formed with a bore 164 which extends normal to the axis of rotation and intersects the latter and which merges at one of its ends with a short bore 165 of lesser diameter. The bore 164 has a shoulder 166 where it merges into the bore 165 and a cylindrical sliding member 167 is received in the bore 164. The tensile element 161 enters the bore 165 and the bore 164 and is connected with the sliding element 167. A spring 168 is received in the bore 164 and is compressed between the shoulder 166 and the element 167.

When the star 121*a* is turned with the front wall 120 relative to the sleeve 130, the tensile element 161 is deflected in circumferential direction and pulls the member 167 counter to the action of the spring 168, until the star 121*a* has been sufficiently turned and the member 167 has been sufficiently pulled to move out of the way of the rod 114. The starting position of the member 167 in the bore 164 and therefore the activating torque, can be adjusted by turning the member 134 and shifting it axially forwardly or rearwardly.

The embodiment in FIGS. 5–7 operates in the same manner as the one described in FIGS. 1–4, except that the embodiment in FIGS. 1–4 will respond to a torque with the activation of the motor 8 only when the spindle 28 rotates in one direction; it cannot so respond if the spindle rotates in the opposite direction. The embodiment of FIGS. 5–7, on the other hand, can respond when the spindle rotates in either direction as long as the wall portion which is engaged by the balls 126 is appropriately configurated. The setting of the torque which deactivates the motor is effected in the same way in both embodiments. The embodiment in FIGS. 5–7 has the advantage as compared to that of FIGS. 1–4 that the torque can be set more precisely.

Both embodiments illustrated are substantially shorter than those known from the prior art, due to the arrangement by which the members 26 or 126 move in radial direction; they can, therefore, be utilized where space is limited, and of course they are also easy to handle, lighter and less expensive than prior-art constructions.

It will be clear that although the drive in the two illustrated embodiments is an air motor, and the switch which is acted upon by the rod 14 or 114 is in form of an air-flow controlling valve, other types of drives can equally well be used. For example, the air motor could be replaced by an electromotor and the valve having the servo valve member could be replaced by an electrical switch having, for example, a plunger that is spring-loaded and moved by engagement with the rod 114 or 14. The tool spindle with its associated chuck can, of course, also be constructed in a manner different from what has been illustrated, since these features do not affect the inventive concept.

It will be understood that each of the elements described above, or two or more together, may also find a useful application in other types of constructions differing from the type described above.

While the invention has been illustrated and described as embodied in a power driver for threaded fasteners, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power driver for screws, nuts and analogous fasteners, comprising a housing; a drive motor in said housing; a motor-control switch activatable for turning on said drive motor and deactivatable for shutting off said drive motor; an output shaft connectable with a fastener to be driven and coupled with said drive for rotation by the same; and means for deactivating said motor-control switch when the torque on said shaft exceeds a predetermined selectable level, said deactivating means including a plurality of first surfaces each surrounding the axis of rotation of said shaft and each being spaced from said axis by a distance which changes substantially continuously from a maximum value to a minimum value in circumferential direction of said axis, a plurality of transmitting members mounted for torque-dependent shifting in direction radially of said axis, and substantially radially arranged biasing springs urging said members radially outwardly against respective ones of said first surfaces, adjacent ones of said first surfaces being connected via second surfaces defining substantially discontinuous transitions between the respectively adjacent first surfaces.

2. A power driver as defined in claim 1, said means comprising a driving element and a driven element which couple said members in circumferential direction.

3. A power driver as defined in claim 2, wherein said elements are connected in axial direction via interengaging portions.

4. A power driver as defined in claim 3, wherein said interengaging portions are constituted by said members and by steps on said driven element.

5. A power driver as defined in claim 3, wherein said interengaging portions comprise slots in said driving element and projections on said driven element which are arranged to engage in said slots.

6. A power driver as defined in claim 2; further comprising a shiftable rod arranged to move to and from a portion in which it deactivates said motor-control switch, and a blocking member connected with one of said elements and movable between positions in which it respectively extends across and is withdrawn from the path of movement of said rod, in dependence upon the operation of the other of said elements.

7. A power driver as defined in claim 1, wherein said drive motor is an air motor and said switch is an air valve which is acted upon by said means.

8. A power driver as defined in claim 1, wherein said second surfaces extend in substantially radial direction of said axis.

9. A power driver as defined in claim 1, wherein said transmitting members are ball-shaped and said means comprises three of said transmitting members.

10. A power driver for screws, nuts and analogous threaded fasteners, comprising a housing; a drive in said housing; an output shaft connectable with a fastener to be driven and coupled with said drive for rotation by the same; means for deactivating said drive when the torque on said output shaft exceeds a predetermined selectable level, said deactivating means including a plurality of surfaces each surrounding the axis of rotation of said shaft and each being spaced from said axis by a distance which changes substantially continuously in circumferential direction of said axis, a plurality of transmitting members mounted for torque-dependent shifting in direction radially of said axis, at least substantially radially arranged biasing springs urging said members radially outwardly against respective ones of said surfaces, a driving element and a driven element which couple said members in circumferential direction; and a shiftable rod arranged to move to and from a position in which it deactivates said drive; a blocking member connected with said driven element and movable between positions in which it respectively extends across and is withdrawn from the path of movement of said rod in dependence upon the operation of said driving element, said blocking member comprising an arm turnably connected with said driven element; spring means urging said arm against an abutment on said driving element; and an adjusting member for adjusting the angular position of the pivot point of said arm relative to said driven element.

11. A power driver for screws, nuts and analogous threaded fasteners comprising a housing; a drive in said housing; an output shaft connectable with a fastener to be driven and coupled with said drive for rotation by the same; means for deactivating said drive when the torque on said output shaft exceeds a predetermined selectable level, said deactivating means including a plurality of surfaces each surrounding the axis of rotation of said shaft and each being spaced from said axis by a distance which changes substantially continuously in circumferential direction of said axis, a plurality of transmitting members mounted for torque-dependent shifting in direction radially of said axis, at least substantially radially arranged biasing springs urging said members radially outwardly against respective ones of said surfaces, a driving element and a driven element which couple said members in circumferential direction, and a shiftable rod arranged to move to and from a position in which it deactivates said drive; a blocking member connected with said driven element and movable between positions in which it respectively extends across and is withdrawn from the path of movement of said rod in dependence upon the operation of said driving element, said blocking member being mounted for sliding movement normal to said axis of rotation on a component which is rigid with said driving element; a link member connecting said blocking member with said driven element at a location spaced from said axis of rotation; and an adjustable pin connecting said link member with said driven element.

* * * * *